US006504446B1

(12) United States Patent
Ishihara et al.

(10) Patent No.: US 6,504,446 B1
(45) Date of Patent: Jan. 7, 2003

(54) METHOD FOR ADJUSTING CHARACTERISTICS OF DIELECTRIC FILTER, METHOD FOR ADJUSTING CHARACTERISTICS OF DIELECTRIC DUPLEXER, AND DEVICES FOR PRACTICING THE METHODS

(75) Inventors: Jinsei Ishihara, Kanazawa (JP); Hideyuki Kato, Ishikawa-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/523,030

(22) Filed: Mar. 10, 2000

(30) Foreign Application Priority Data

Mar. 10, 1999 (JP) ..... 11-063457
Mar. 10, 1999 (JP) ..... 11-063458

(51) Int. Cl.[7] ..... H01P 1/205
(52) U.S. Cl. ..... 333/17.1; 333/202; 333/207
(58) Field of Search ..... 333/17.1, 207, 333/223, 202, 134, 222, 206, 235

(56) References Cited

U.S. PATENT DOCUMENTS 5,528,204 A * 6/1996 Hoang et al. ..... 333/134
5,764,116 A * 6/1998 Ishikawa et al. ..... 333/202
5,815,056 A * 9/1998 Tada et al. ..... 333/202

* cited by examiner

*Primary Examiner*—Robert Pascal
*Assistant Examiner*—Dean Takaoka
(74) *Attorney, Agent, or Firm*—Dickstein, Shapiro, Morin & Oshinsky, LLP.

(57) ABSTRACT

A method which is capable of easily obtaining specified filter characteristics in a short time, even in the case of a dielectric filter having complicated relationships between changes in the filter characteristics and the amount that a specified part of a dielectric member or a dielectric film is trimmed. In the dielectric filter, data is obtained in advance showing the relationships between the amounts that specified parts of a conductive film or a dielectric member are trimmed, and the corresponding changes in the values of a center frequency and a coupling coefficient between resonators. Further, adjustment values are obtained from the initial characteristics of the dielectric filter to be adjusted, and then, the targeted amounts of trimming are obtained from the adjustment values, targeted adjustment values, and the aforementioned data concerned so as to perform trimming.

20 Claims, 15 Drawing Sheets

| ELEMENT | CHARACTERISTICS | ELEMENT | LOW | HIGH |
|---|---|---|---|---|
| Qe1 | CQe1[pF] | 1.388 | 1.374 | 1.402 |
| Qe2 | CQe2[pF] | 1.388 | 1.374 | 1.402 |
| Qe2 | Ck12[pF] | 0.592 | 0.568 | 0.059 |
| | | | | |
| R1 | εr | 90 | —— | —— |
| | Za[Ω] | 7.336 | —— | —— |
| | L [mm] | 7.413 | 7.339 | 7.487 |
| | | | | |
| R2 | εr | 90 | —— | —— |
| | Za[Ω] | 7.336 | —— | —— |
| | L [mm] | 7.413 | 7.339 | 7.487 |

| | FILTER CHARACTERISTICS | CENTER | R1-LOW | R1-HIGH | R2-LOW | R2-HIGH | k12-LOW | k12-HIGH | Qe1-LOW | Qe1-HIGH | Qe2-LOW | Qe2-HIGH |
|---|---|---|---|---|---|---|---|---|---|---|---|---|
| A1 | FO [MHz] | 1000.62 | 995.90 | 1005.51 | 995.90 | 1005.51 | 1002.22 | 999.03 | 1001.94 | 999.58 | 1001.94 | 999.58 |
| A2 | 3dBBW | 49.27 | 50.53 | 51.53 | 50.53 | 51.53 | 44.60 | 53.76 | 49.07 | 49.21 | 49.07 | 49.21 |
| | | | | | | | | | | | | |
| B1 | BOTTOM NUMBER | 2 | 2 | 2 | 2 | 2 | 2 | 2 | 2 | 2 | 2 | 2 |
| B2 | BOTTOM 1 FREQ.[MHz] | 990.77 | 983.75 | 996.00 | 986.25 | 993.45 | 997.16 | 986.27 | 991.10 | 992.04 | 990.21 | 999.00 |
| B3 | BOTTOM 1 REFLECTION COEFFICIENT FACTOR | 0.0465 | 0.2054 | 0.2194 | 0.3101 | 0.1782 | 0.0302 | 0.0641 | 0.1784 | 0.0493 | 0.0453 | 0.0300 |
| B4 | BOTTOM 1 FREQ.[MHz] | 1008.27 | 1003.25 | 1015.75 | 1005.49 | 1013.25 | 1005.82 | 1009.97 | 1011.93 | 1004.89 | 1011.84 | 1005.53 |
| B5 | BOTTOM 1 REFLECTION COEFFICIENT FACTOR | 0.0441 | 0.3080 | 0.1712 | 0.1681 | 0.2871 | 0.0281 | 0.0606 | 0.0532 | 0.0643 | 0.0783 | 0.0070 |
| B6 | BOTTOM 1 FREQ.[MHz] | 999.25 | 997.50 | 1001.75 | 992.50 | 1007.25 | 1001.37 | 997.92 | 999.92 | 998.89 | 1001.00 | 999.90 |
| B7 | BOTTOM 1 REFLECTION COEFFICIENT FACTOR | 0.1600 | 0.3010 | 0.3003 | 0.3027 | 0.3181 | 0.0462 | 0.2280 | 0.2405 | 0.0880 | 0.2241 | 0.0900 |
| | | | | | | | | | | | | |
| C1 | AMOUNT OF ADJUSTMENT OF CQe1 | 0.0 | 0.0 | 0.0 | 0.0 | 0.0 | 0.0 | 0.0 | +0.6 | −0.6 | 0.0 | 0.0 |
| C2 | AMOUNT OF ADJUSTMENT OF CQe2 | 0.0 | 0.0 | 0.0 | 0.0 | 0.0 | 0.0 | 0.0 | 0.0 | 0.0 | +0.6 | −0.6 |
| C3 | AMOUNT OF ADJUSTMENT OF Ck12 | 0.0 | 0.0 | 0.0 | 0.0 | 0.0 | +0.5 | −0.5 | 0.0 | 0.0 | 0.0 | 0.0 |
| C4 | AMOUNT OF ADJUSTMENT OF L OF R1 | 0.0 | −0.4 | +0.4 | 0.0 | 0.0 | 0.0 | 0.0 | 0.0 | 0.0 | 0.0 | 0.0 |
| C5 | AMOUNT OF ADJUSTMENT OF L OF R2 | 0.0 | 0.0 | 0.0 | −0.4 | +0.4 | 0.0 | 0.0 | 0.0 | 0.0 | 0.0 | 0.0 |

*FIG. 10*

| | FILTER CHARACTERISTICS | CENTER | R1-LOW | R1-HIGH | R2-LOW | R2-HIGH | k12-LOW | k12-HIGH | Qe1-LOW | Qe1-HIGH | Qe2-LOW | Qe2-HIGH |
|---|---|---|---|---|---|---|---|---|---|---|---|---|
| A1 | △FO [MHz] | 0.0 | -4.72 | 4.89 | -4.27 | 4.89 | 1.6 | -1.59 | 1.32 | -1.04 | 1.32 | -1.04 |
| A2 | △ 3dBBW | 0.0 | 1.26 | 2.26 | 1.26 | 2.26 | -4.67 | 4.49 | -0.2 | -0.06 | -0.2 | |
| | | | | | | | | | | | | |
| B1 | BOTTOM NUMBER | 2 | 2 | 2 | 2 | 2 | 2 | 2 | 2 | 2 | 2 | 2 |
| B2 | △BOTTOM 1 FREQ.[MHz] | 0.0 | -7.02 | 5.23 | -4.25 | 2.68 | 6.39 | -4.5 | 0.33 | 1.27 | -0.56 | |
| B3 | BOTTOM 1 REFLECTION COEFFICIENT FACTOR | 0.0 | 4.42 | 6.27 | 6.67 | 3.83 | 0.65 | 1.38 | | | | |
| B4 | △BOTTOM 1 FREQ.[MHz] | 0.0 | -5.02 | 7.48 | -2.78 | 4.89 | | | | | | |
| B5 | BOTTOM 1 REFLECTION COEFFICIENT FACTOR | 0.0 | 6.98 | 3.88 | 3.81 | 6.5 | | | | | | |
| B6 | △BOTTOM 1 FREQ.[MHz] | 0.0 | -1.75 | 2.5 | -6.75 | 8.0 | | | | | | |
| B7 | BOTTOM 1 REFLECTION COEFFICIENT FACTOR | 0.0 | 1.88 | 1.87 | 1.89 | 1.99 | 0.29 | 1.42 | | | | |
| | | | | | | | | | | | | |
| C1 | AMOUNT OF ADJUSTMENT OF CQe1 | 0.0 | 0.0 | 0.0 | 0.0 | 0.0 | 0.0 | 0.0 | +0.6 | -0.6 | 0.0 | 0.0 |
| C2 | AMOUNT OF ADJUSTMENT OF CQe2 | 0.0 | 0.0 | 0.0 | 0.0 | 0.0 | 0.0 | 0.0 | 0.0 | 0.0 | +0.6 | -0.6 |
| C3 | AMOUNT OF ADJUSTMENT OF Ck12 | 0.0 | 0.0 | 0.0 | 0.0 | 0.0 | +0.5 | -0.5 | 0.0 | 0.0 | 0.0 | 0.0 |
| C4 | AMOUNT OF ADJUSTMENT OF L OF R1 | 0.0 | -0.4 | +0.4 | 0.0 | 0.0 | 0.0 | 0.0 | 0.0 | 0.0 | 0.0 | 0.0 |
| C5 | AMOUNT OF ADJUSTMENT OF L OF R2 | 0.0 | 0.0 | 0.0 | -0.4 | +0.4 | 0.0 | 0.0 | 0.0 | 0.0 | 0.0 | 0.0 |

*FIG. 15*

METHOD FOR ADJUSTING CHARACTERISTICS OF DIELECTRIC FILTER, METHOD FOR ADJUSTING CHARACTERISTICS OF DIELECTRIC DUPLEXER, AND DEVICES FOR PRACTICING THE METHODS

BACKGROUND OF THE INVENTION

1. Field of the Invention

The present invention relates to methods for adjusting the characteristics of dielectric filters such as dielectric duplexers and devices for practicing the methods.

2. Description of the Related Art

A conventional method (1) for adjusting the characteristics of dielectric filters is shown in Japanese Examined Patent Publication No. 7-52206, which provides a device in which the state values of elements disposed in a filter constituted of lumped-constant elements or distributed-constant elements are determined in such a manner that the difference between a value of measured vector information and a value calculated according to an equivalent circuit of the filter is as small as possible, and adjustments are made such that the determined state values of the elements coincide with targeted values. In addition, an article (2) titled "ON COMPUTER AIDED TUNING OF MICROWAVE FILTERS," IEEE Proc. ISCAS/76 introduces a device in which a target of (resonant frequency), used when a resonator is tuned by the characteristics of a reflection phase, is equivalent to the of of the filter. Furthermore, Japanese Unexamined Patent Publication No. 4-240901 (3) provides a device for trimming an electronic component in which changes in the characteristics with respect to the amounts of processing are memorized to update trimming conditions by using an average value of performance information obtained from the cumulative data.

Dielectric filters have a higher Q than surface acoustic wave filters or multi-layer substrate-type filters and have good temperature characteristics. Furthermore, in such dielectric filters, it is easy to make adjustments by a trimming process. As a result, the dielectric filters are suitable for applications requiring superior characteristics. However, it is difficult to apply the above-described conventional adjusting methods to the dielectric filters.

In other words, for example, as in the case of a basic low pass filter of the Chebyshev type, a filter-adjustment device described in (1) is usable when the equivalent circuit of the filter has a simple and clear configuration. However, it is difficult to make adjustments of filter characteristics in a short time in the case of a dielectric filter in which many elements of the equivalent circuit of the dielectric filter are influenced by adjusting a certain specified part.

The method for adjusting a filter described in (2) is a method of tuning conducted by using the fact that, in a case of a typical type of band pass filter (BPF), the pass phase between resonators is 90° (the reflection phase is 180°). This method can be used in a Chebyshev-type BPF, and the like. However, the method cannot be used with a block-type dielectric filter having an attenuation pole outside a pass band, or when the BPF characteristics are changed.

The device for trimming an electronic component described in (3) is usable when the amounts of processing and the amounts of changing of characteristics are closely related by first-order expressions. However, regarding a dielectric filter in which a conductive film is formed on a dielectric block, it is impossible to adjust the characteristics only with the aid of approximate first-order expressions simply using average values, since the relationships between the amounts of processing and changes in the characteristics are complicated.

SUMMARY OF THE INVENTION

To overcome the above described problems, embodiments of the present invention provide a method for adjusting the characteristics of a dielectric filter, a method for adjusting the characteristics of a dielectric duplexer, and a device for adjusting the characteristics, in which specified characteristics can be easily obtained in a short time, even in the case of a dielectric filter in which there are complicated relationships between the amount that a specified part of a dielectric member or a conductive film is trimmed, and the corresponding changes in the characteristics, such as a dielectric filter and a dielectric duplexer produced by forming a conductive film on a dielectric block.

One embodiment of the present invention provides a method for adjusting the characteristics of a dielectric filter produced by forming a conductive film on a dielectric member, including the steps of: first, obtaining in advance data on the relationships between amounts of trimming and adjustment values, the data showing the relationships between the amounts of trimming a specified part of the conductive film or the dielectric member of a sample dielectric filter and changes in the adjustment values of a central frequency, a coupling coefficient between resonators, and the like; second, measuring the characteristics of a dielectric filter to be adjusted to obtain the adjustment values of the dielectric filter from the measured characteristics; third, obtaining a targeted amount of trimming the conductive film or the dielectric member based on both the difference between the adjustment values and targeted adjustment values and the data on the relationships between the amounts of trimming and the adjustment values; and fourth, trimming the conductive film or the dielectric member of the dielectric filter, based on the targeted amount of trimming.

In this way, in the first step, the relationships between the amount of trimming the dielectric member or the conductive film of the sample dielectric filter and the changes in the adjustment values of the central frequency, the coupling coefficient between resonators, and the like, are obtained. In the second step, the adjustment values of the filter are obtained from the characteristics of the dielectric filter to be adjusted. Third, the targeted amount of trimming the conductive film or the dielectric member is obtained from the targeted adjustment values and the data on the relationships between the amounts of trimming and the adjustment values. And fourth, the conductive film or the dielectric member of the dielectric filter is trimmed according to the targeted amount of trimming.

As a result, even in the case of a dielectric filter such as a dielectric duplexer, in which changes in a central frequency, a coupling coefficient, and the like, are influenced by trimming even one part, adjustments of the characteristics can be automatically and efficiently performed in a short time.

In addition, in the above described method, changes in the adjustment values of the dielectric filter caused by trimming of the conductive film or the dielectric member of the dielectric filter are obtained, to correct the data relating to the relationships between the amounts of trimming and the adjustment values. With this arrangement, when there are variations in the relationships between the amounts of trimming and the adjustment values in the dielectric filter, the data pertaining to the relationships between the amounts of trimming and the adjustment values in the sample dielectric filter is corrected when the dielectric filter is adjusted, with the result that the accuracy of the data showing the relationships between the amounts of trimming and the changes in the adjustment values is gradually enhanced.

In addition, in the above described method, the data on the relationships between the amounts of trimming and the adjustment values is expressed in terms of coefficients of functions expressing the changes in the adjustment values with respect to the amounts of trimming. With this arrangement, the functions can be easily expressed, and the correction of the data showing the relationships between the amounts of trimming and the changes in the adjustment values can also be facilitated.

Furthermore, in the above described method, the second step is repeated multiple times in such a manner that the amount of trimming the conductive film or the dielectric member at one time in the second step is smaller than the targeted amount of trimming. With this arrangement, excessive trimming can be prevented since gradual adjustments are performed until the targeted characteristics of the dielectric filter are obtained.

Furthermore, in the above described method, a ceiling value is set on the amount of trimming the conductive film or the dielectric member at one time in the second step or the targeted amount of trimming. With this arrangement, production of a dielectric filter incapable of being adjusted due to excessive trimming can be prevented.

Another embodiment of the present invention provides a method comprising the steps of: first, creating a database showing the relationships between the filter characteristics of a dielectric filter before adjustment, and the amount of adjustment of adjusted parts which are necessary to obtain a specified filter characteristic based on the initial filter characteristics, when the characteristics of the dielectric filter such as a dielectric duplexer are adjusted, and second, measuring the filter characteristics of the dielectric filter to obtain from the database the amount of adjustment corresponding to the filter characteristics, so as to be able to make adjustments according to the obtained amount of adjustment.

According to the above described method, the amount of trimming necessary to obtain the specified filter characteristic, given the initial filter characteristics of the dielectric filter before adjustment of its characteristics, is stored as a database in advance, and based on the database, the amount of adjustment is obtained according to the initial characteristics of the dielectric filter.

As a result, even when the equivalent circuit of the dielectric filter is complicated and many elements of the equivalent circuit are thereby influenced by the adjustment of one certain part, with the use of the relationships between the amount of actual adjustment and the changes in the filter characteristics of the dielectric filter, a desired filter characteristic of the dielectric filter can be reproduced with high precision, thereby leading to enhancement in the efficiency of adjustment of characteristics.

In addition, in the above described method, the relationships between the filter characteristics of the dielectric filter and the amount of adjustment obtained by the second step are entered in the database created by the first step. With this procedure, every time the characteristics of the dielectric filter are measured and adjusted, the content of the database is increased. Furthermore, it is possible to make adjustments with respect to a wide range of variations in the filter characteristics of the dielectric filter before adjustments of the characteristics.

Other features and advantages of the present invention will become apparent from the following description of the invention which refers to the accompanying drawings.

BRIEF DESCRIPTION OF THE DRAWINGS

FIG. 10 is a chart showing the relationships between the filter characteristics of the dielectric filter and the amounts of adjustments.

FIG. 15 is a chart showing the relationships between filter characteristics and the amounts of adjustments obtained when targeted filter characteristics of a dielectric resonator are normalized as standard criteria.

DESCRIPTION OF EMBODIMENTS OF THE INVENTION

First Embodiment

Referring to FIGS. 1A to 6, a description will be given of a method for adjusting the characteristics of a single dielectric filter according to a first embodiment of the present invention.

Figure 1A:
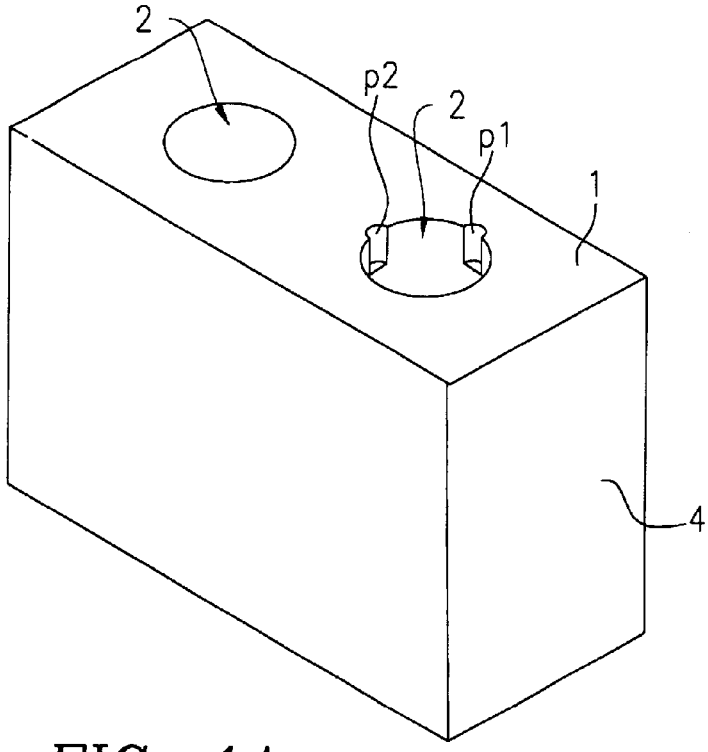
FIG. 1A and FIG. 1B are views showing the structure of a dielectric filter according to a first embodiment of the present invention.
Figure 1B:
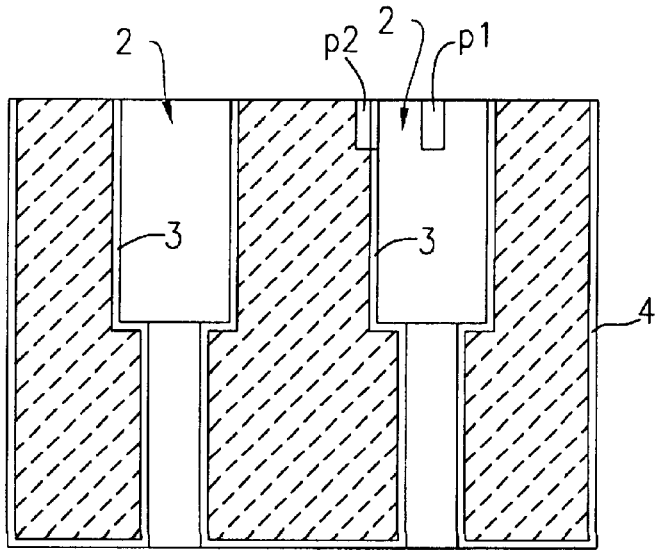

FIGS. 1A and 1B show views illustrating the structure of the dielectric filter, in which FIG. 1A is a perspective view and FIG. 1B is a sectional view thereof. In FIGS. 1A and 1B, reference numeral 1 indicates a dielectric block having a rectangular parallelepiped configuration, in which two holes 2 are formed, extending from one end face to the other opposing end face. On the inner surfaces of the holes 2, inner conductors 3 are formed. On the external surfaces of the dielectric block 1, outer conductors 4 are disposed on the remaining five surfaces except the top surface in the figure. In this arrangement, the top surface in the figure is an open surface (the open-circuited ends of the resonators), and the bottom surface is a short-circuited surface (the short-circuited ends of the resonators).

As shown in FIG. 1B, the holes 2 are stepped holes, in which the inner diameters of the open end and the short-circuited end are different.

Figure 2:
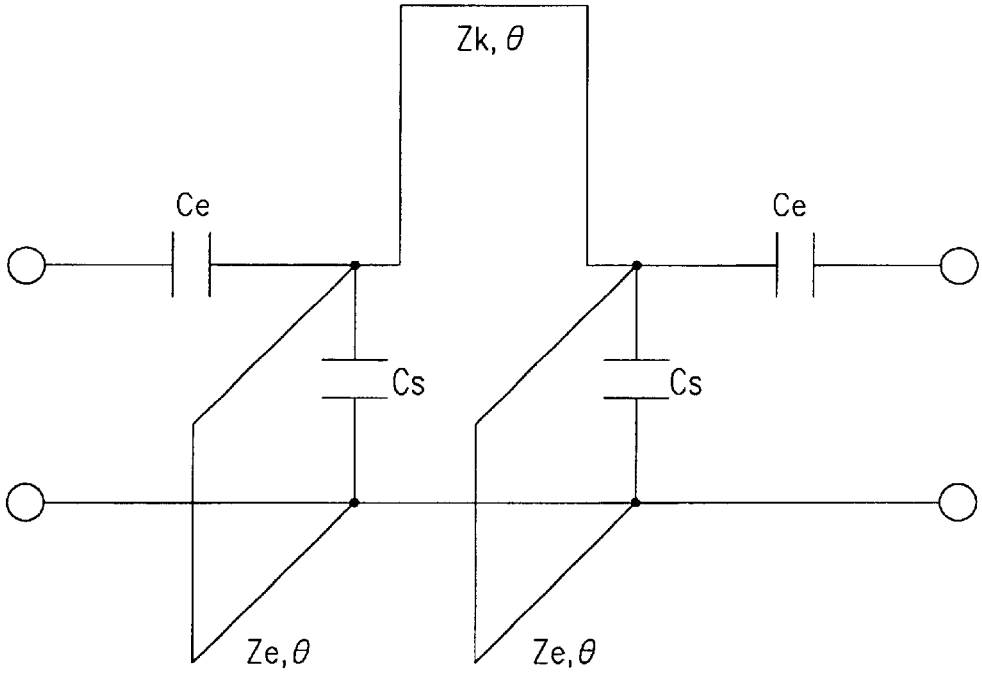
FIG. 2 is an equivalent circuit diagram of the dielectric filter.

FIG. 2 is an equivalent circuit view of the dielectric filter shown in FIGS. 1A and 1B. In this figure, reference character Ze indicates an even-mode impedance of a resonator, reference character Zk indicates a coupling impedance, reference character θ indicates an electrical angle at the central frequency of the filter, reference character Cs indicates a stray capacitance at the open end, and reference character Ce indicates a coupling capacitance with respect to the external part.

In FIG. 1A, reference numerals p1 and p2 indicate parts trimmed when the characteristics are adjusted. In this case, parts of the inner conductors extending along the axes of the holes and having certain fixed widths are trimmed, along with parts of the dielectric member. The amount of trimming is changed according to the lengths of the axes of the holes.

Figure 3:
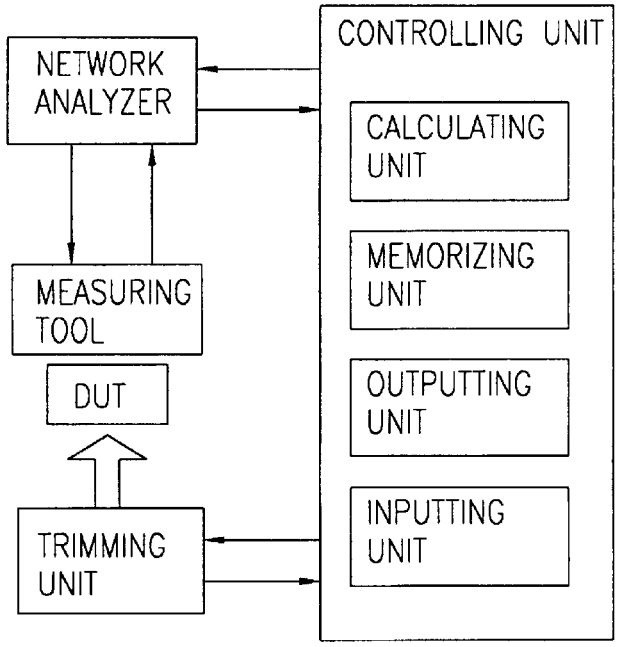
FIG. 3 is a block diagram showing the structure of a device for adjusting the characteristics of a dielectric filter.

FIG. 3 is a block diagram illustrating the entire structure of a device for adjusting the characteristics of a dielectric filter. In this case, a dielectric filter DUT is the dielectric filter having the structure shown in FIGS. 1A and 1B, and is set in a measuring tool. A network analyzer measures S parameters (pass characteristics and reflection characteristics) and the like of the dielectric filter DUT. A controlling unit comprises a calculating unit, a memorizing unit, an outputting unit, and an inputting unit. For example, the controlling unit may be comprised of a microcomputer having input/output ports. Based on control data provided by the controlling unit, a trimming unit trims only specified amounts, only of specified parts, of the dielectric filter DUT.

In this situation, the central frequency of of a pass band and the coupling coefficient k between the resonators are used as the adjustment values of the dielectric filter. The central frequency of and the coupling coefficient k are obtained from the equivalent circuit shown in FIG. 2. In other words, the network analyzer shown in FIG. 3 measures S parameters (S11, S12, S21, and S22) in a specified frequency band of the dielectric filter, and the central frequency of and the coupling coefficient k are obtained by the controlling unit from these values.

As the method for obtaining the central frequency of, the coupling coefficient k, and the like, from S parameters, for example, a method described in "Measurements of Inter-cavity Coupling" IEEE MTT pp.519-523 (1975. 6) is used.

Figure 4A:
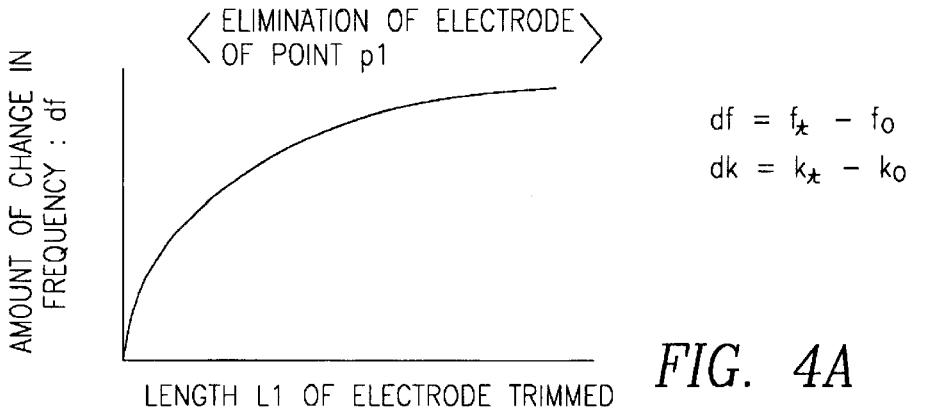
FIG. 4A, FIG. 4B, FIG. 4C and FIG. 4D are graphs showing the relationships between the amounts of trimming and adjustment values.

FIGS. 4A to 4D show the relationships between the amounts of trimming the two adjusted parts p1 and p2 shown in FIG. 1 and the changes in the adjustment values described above. FIG. 4A shows the relationship of the length that the first part is trimmed and the corresponding change df in the central frequency of. The trim length L1 required to move the actual central frequency of to the target central frequency can be determined from this graph.

Figure 4B:
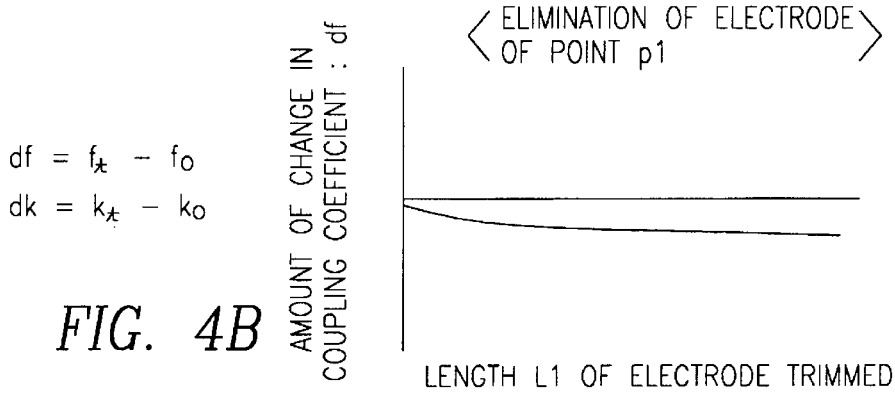
Figure 4C:
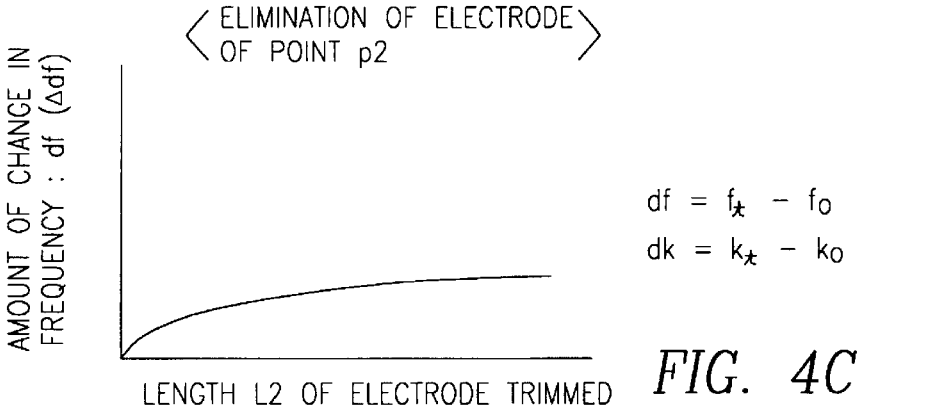
Figure 4D:
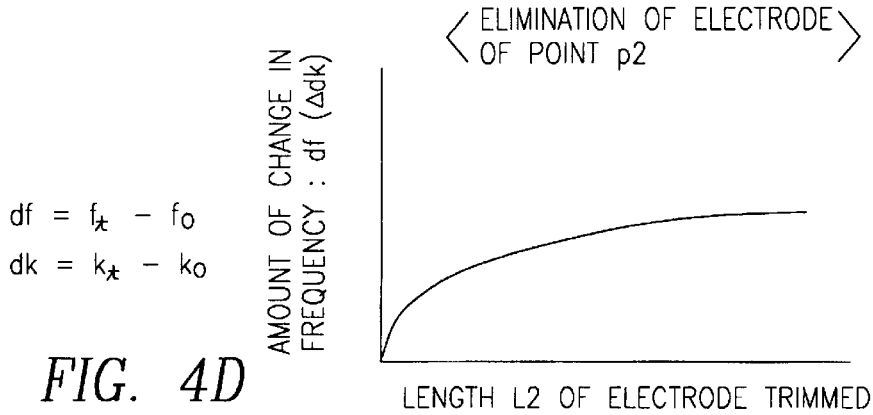

FIG. 4B shows the relationship of the length that the first part is trimmed and the corresponding change dk in the coupling coefficient k. The trim length L1 required to move the actual coupling coefficient k to the desired (target) coefficient can be determined from this graph. Similarly, FIG. 4C shows the relationship between the trim length L2 of the second part and the resulting change in the central frequency of and FIG. 4D shows the relationship between the trim length L2 of the second part and the resulting change in the coupling coefficient k. As shown in these figures, variations in the length L1 of the trimmed part p1 have a greater effect on the difference df than on the difference dk. In contrast, variations in the length L2 of the trimmed part p2 have a greater effect on the difference dk than on the difference df. Stated otherwise, trimming of the part p1 is more effective in adjusting the value of the central frequency of than in adjusting the value of the coupling coefficient k while trimming of the part p2 is more effective in adjusting the value of the coupling coefficient k than in adjusting the value of the central frequency fo.

In this case, the above values of df and dk are expressed by the following equations. Regarding the trimmed part p1, $$df = A1 \cdot L1^{1/B1}$$

$$dk = A3 \cdot L1^{1/B3}$$

Regarding the trimmed part p2, $$df = A2 \cdot L2^{1/B2}$$

$$dk = A4 \cdot L2^{1/B4}$$

When these results are put altogether to express the amounts L1 and L2 of trimming, the equations below are obtained.

$$L1 = (df/A1)^{B1}$$

$$L1 = (dk/A3)^{B3}$$

$$L2 = (df/A2)^{B2}$$

$$L2 = (df/A4)^{B4}$$

In addition, since A1, A2, A3, A4, B1, B2, B3, and B4 are constant numbers, the following N-order expressions can be obtained.

$$L1 = A1' df^{B1} \quad (1)$$

$$L1 = A3' dk^{B3} \quad (2)$$

$$L2 = A2' df^{B2} \quad (3)$$

$$L2 = A4' dk^{B4} \quad (4)$$

As a result, in order to change the central frequency by the value of df and change the coupling coefficient by the value of dk, the amount L1 of trimming necessary for the trimmed parts p1 and the amount L2 of trimming necessary for the trimmed parts p2 are obtained by the following equations.

$$L1 = A1' d^{B1} + A3' dk^{B3}$$

$$L2 = A2' d^{B2} + A4' dk^{B3}$$

Ceiling values of L1 and L2 are set in advance so as to avoid performing excessive trimming in any trimming step. Furthermore, as shown in the following equations, values obtained by multiplying the values of L1 and L2 by constant coefficients X and Y, which are smaller than 1.0, are set as the amounts of trimming that are performed in one trimming step.

$$L1'=X\cdot A1'df^{B1}+Y\cdot A3'dk^{B3} \quad (5)$$

$$L2'=X\cdot A2'df^{B2}+Y\cdot A4'dk^{B3} \quad (6)$$

Next, referring to FIGS. 5 and 6, the detailed procedure of the method for adjusting the characteristics will be illustrated below.

Figure 5:
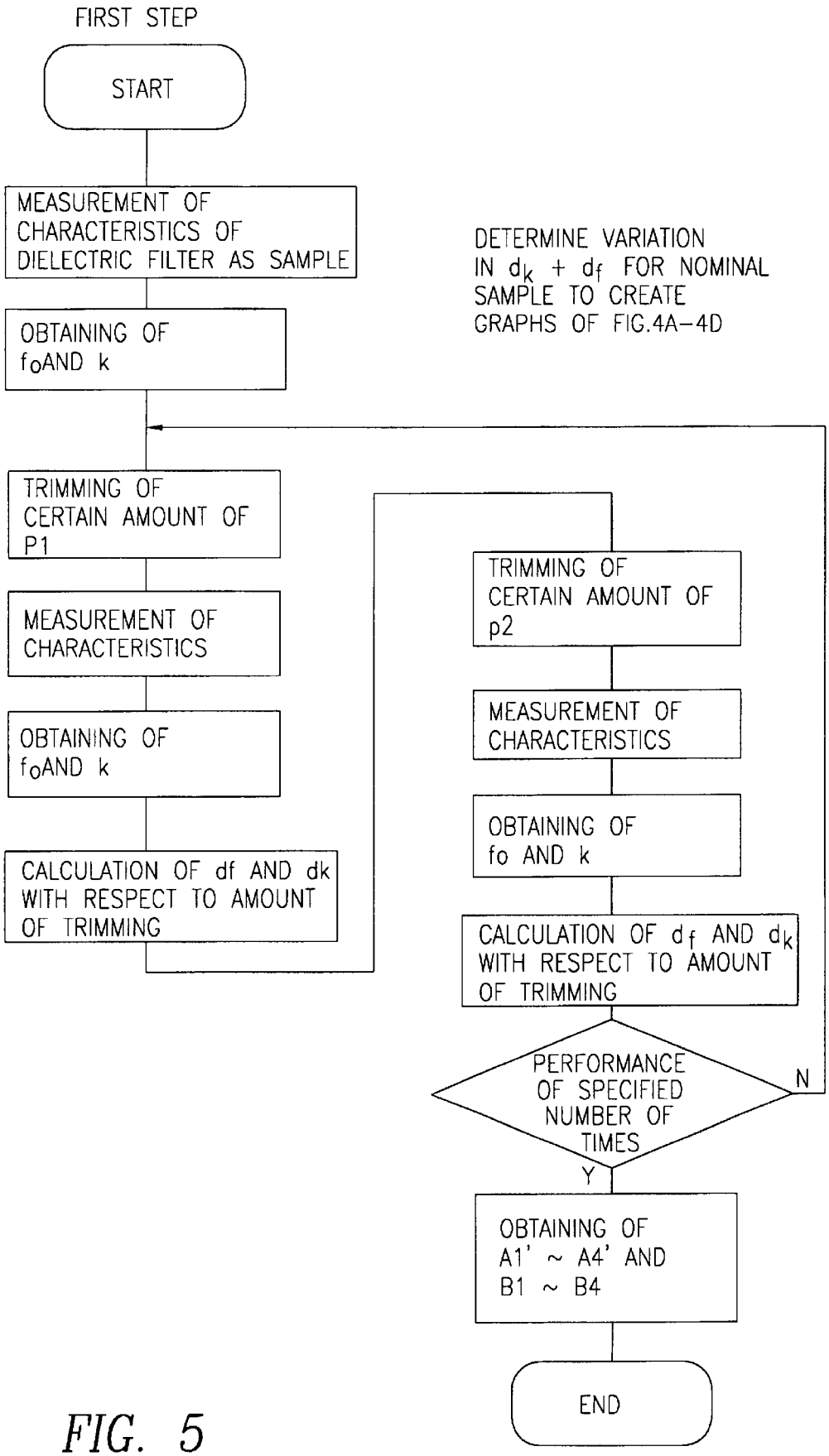
FIG. 5 is a flowchart illustrating the procedure of a method for adjusting the characteristics of a dielectric filter.

First, data pertaining to the relationships between the amounts of trimming and adjustment values (based upon measurements taken on a standard sample dielectric filter) is obtained in the procedure shown in FIG. 5. The filter characteristics (S parameters in a specified frequency band) of the sample dielectric filter (the dielectric filter before trimming of the trimmed parts p1 and p2 shown in FIG. 1) are first measured by a network analyzer. Then, based on these S parameters, the central frequency of of a pass band and the coupling coefficient k between resonators are obtained.

After this, only a certain amount of the trimmed part p1, i.e., an estimated value of L1, is trimmed. Then, the measurement of the filter characteristics is performed again to obtain the central frequency of and the coupling coefficient k. Sequentially, the change df of the central frequency and the change dk of the coupling coefficient with respect to the present amount of trimming are calculated. In other words, the amounts of change between the values of of and k before trimming and the present values of of and k are obtained.

Next, a certain amount of the trimmed part p2, i.e., an estimated value of L2, is trimmed. The filter characteristics are measured to obtain the values of of and k, and the values of df and dk with respect to the amount of trimming the trimmed part p2 are calculated. That is, the amounts of change from the values of of and k before trimming of p2 to the values of of and k after performing the above described trimming are obtained.

Trimming of the above described amounts of the trimmed parts p1 and p2, i.e., the estimated values of L1 and L2, and calculation of the values of df and dk according to the trimmings are repeatedly performed a sufficient number of times to obtain the data of the relationships between the amounts of trimming and the adjustment values shown in FIGS. 4A to 4D. With this procedure, data of the relationships between the amounts of trimming and adjustment values shown in FIGS. 4A–4D is obtained, and when the relationships are approximated by the equations (1) to (4), coefficients A1' to A4' and B1 to B4 in the equations (1) to (4) are obtained.

Figure 6:
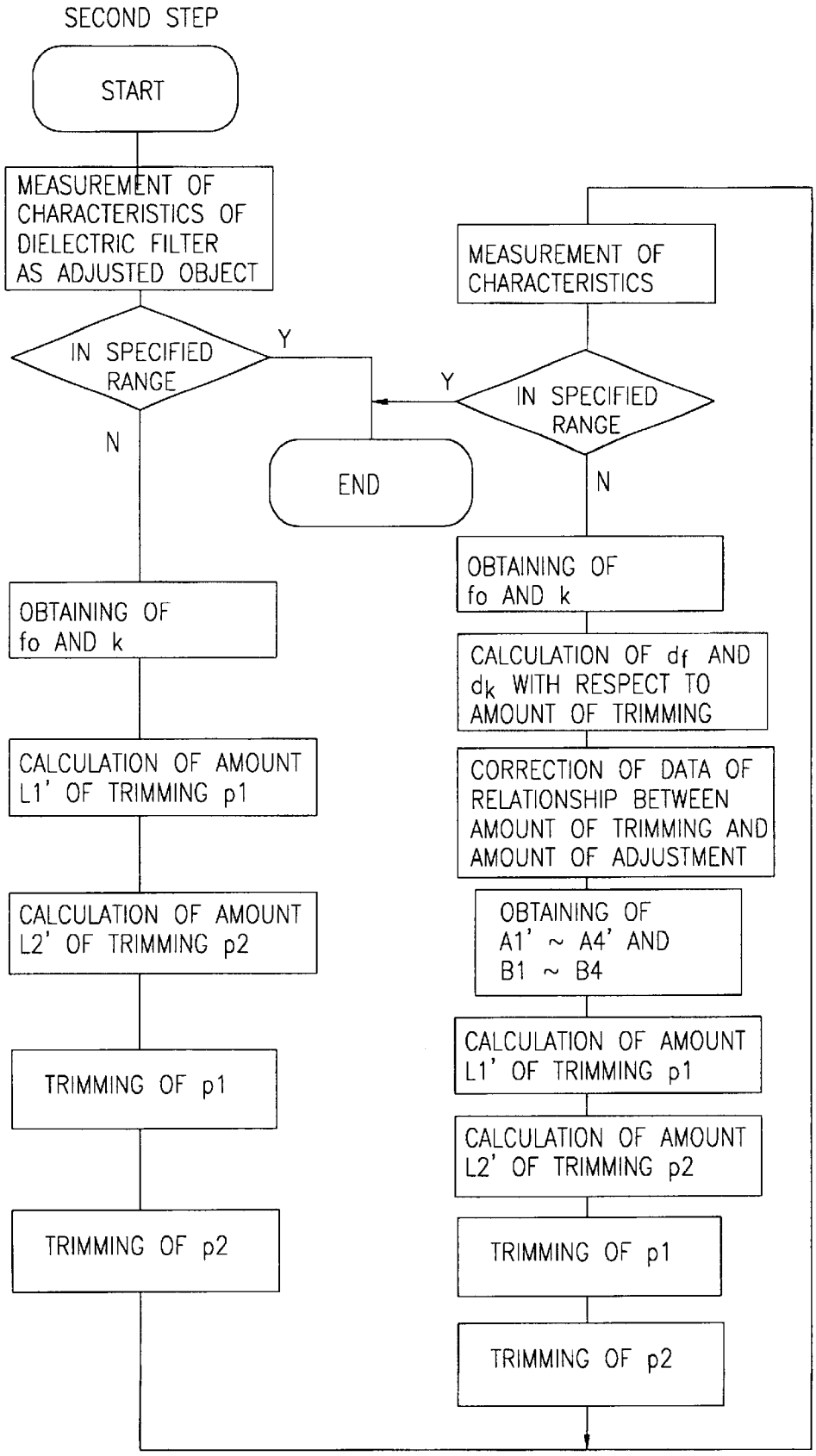
FIG. 6 is a flowchart illustrating the procedure of a method for adjusting the characteristics of a dielectric filter.

Next, an actual adjustment of the characteristics of a dielectric filter whose characteristics are to be adjusted is performed by the procedure shown in FIG. 6. First, the characteristics of the dielectric filter as the object for adjustment are measured. If the measured values are within a range of determined values, adjustment of the characteristics after that is unnecessary, which leads to the completion of the adjustment procedure. If the values are not within the range of determined values, the values of of and k are obtained from S parameters in a measured specified frequency band, and the differences df and dk between the obtained values and the values of a targeted central frequency and a targeted coupling coefficient, respectively, are obtained. Then, the obtained values of df and dk are substituted into the equations (5) and (6) to calculate the necessary amount L1 of trimming the trimmed part p1 and the necessary amount L2 of trimming the trimmed part p2, respectively. After this, the parts p1 and p2 are actually trimmed according to the amounts of trimming obtained.

After that, S parameters are again measured, and if the measured values are contained in the range of determined values, the procedure is ended. When the values are not within the range of determined values, the values of of and k are again obtained to correct the data of the relationships between the amounts of trimming and adjustment values. In other words, when the relationships between the amounts of trimming and the adjustment values obtained in the first step accurately match the dielectric filter under adjustment in the step 2, it is not necessary to change the data of the relationships between the amounts of trimming and adjustment values. However, there is a case in which the above-described relationships showing the differences df and dk between the amounts of trimming and the targeted values of of and k deviate from the curves shown in FIGS. 4A to 4D. In this case, the differences df and dk between the present amounts of trimming (i.e., L1', L2') and the targeted values of of and k are calculated to correct (supplement) the data of the relationships between the amounts of trimming and the adjustment values already obtained. Then, new coefficients A1' to A4' and B1 to B4 of functions expressing the curves of changes in adjustment values with respect to the amounts of trimming are obtained.

After this, the difference df between a targeted central frequency and the present of, and the difference dk between a targeted coupling coefficient and the present coupling coefficient k are substituted into the equations (5) and (6) to calculate the amounts L1 and L2 of trimming, and the trimming is performed. Then, the procedure is repeated to gradually make the values of the central frequency and the coupling coefficient closer to the targeted values. With the procedure, df, dk, L1', and L2' gradually become smaller. As the result of measuring of the characteristics after trimming, adjustments in the characteristics are completed when S parameters are contained in the range of determined values.

In the above description, in order to make illustration and understanding easier, a band pass filter with two coupled stages is used as an example, and the values of the central frequency and the coupling coefficient are used to obtain the amounts of trimming L1 and L2. When resonators of three or more stages are used, there are a plurality of coupling coefficients. In addition, a coupling capacitance with an external coupling electrode is also used to obtain the amounts of trimming L1 and L2.

Furthermore, although the above embodiment adopts the example of a single dielectric filter, the present invention can be similarly applied to the case of a dielectric duplexer in which a conductive film is formed on a single dielectric member such as the aforementioned dielectric block to form a pair of dielectric filters. In other words, in such a dielectric duplexer, the characteristics of the transmitting filter section and the characteristics of the receiving filter section can be separately adjusted. Additionally, branch characteristics of an antenna port may be used to obtain the amounts of trimming L1 and L2. (The "branch characteristics" represent the degree of affection between the two filters in the duplexer). Ideally, the degree of affection of one filter in the pass-band of the other filter is 0, i.e., the phase of the return-loss of one filter in the pass-band of the other filter is 180°. Practically, the desired branch characteristics are obtained by adjusting both filters' characteristics. In the present invention, the filters' characteristics are adjusted by performing the trimming described herein.) With this arrangement, a dielectric duplexer having satisfactory branch characteristics can be easily obtained. The dielectric duplexer can prevent a transmitted signal from passing through the receiving filter and can prevent a received signal from passing through the transmitting filter.

Second Embodiment

Referring to FIGS. 7A to 17, a description will be given of a method for adjusting the characteristics of a dielectric filter according to a second embodiment of the present invention.

Figure 7A:
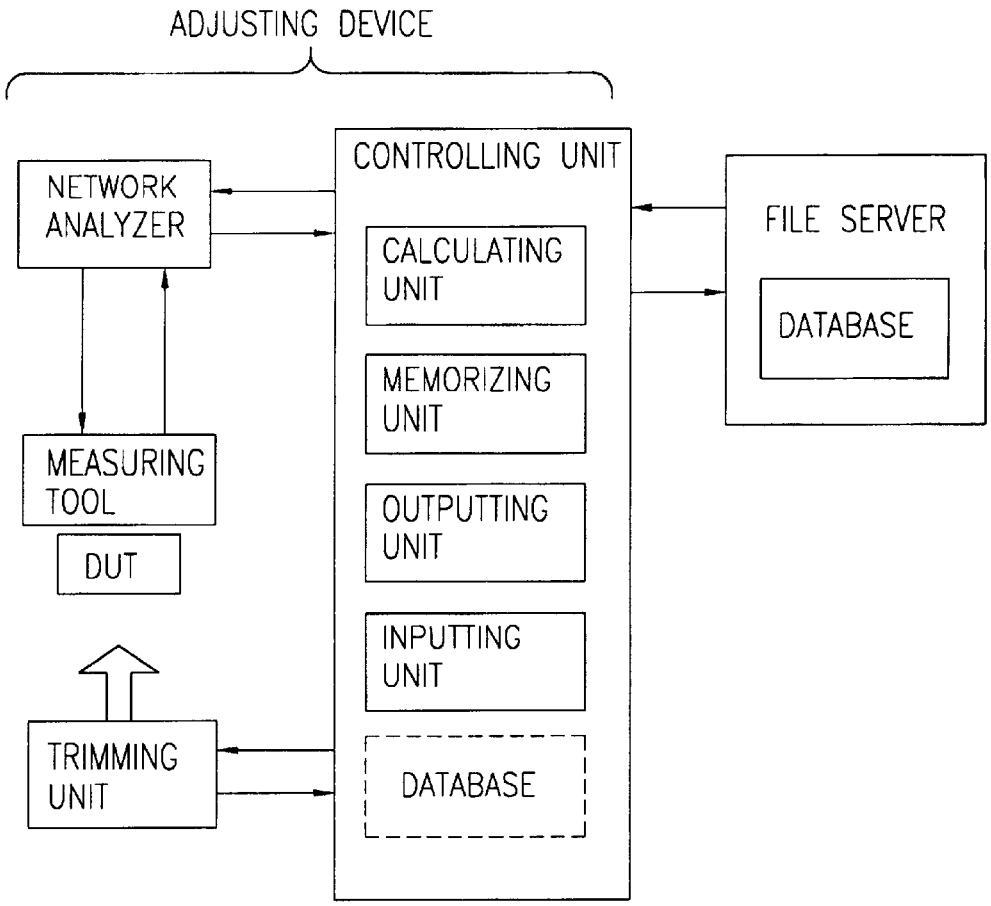
FIGS. 7A and 7B are block diagrams showing the structure of a device for adjusting the characteristics of a dielectric filter.
Figure 7B:
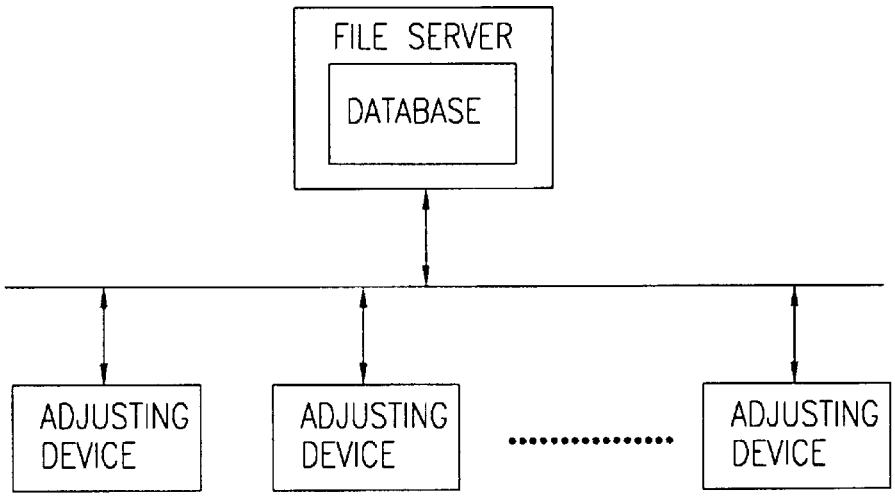

FIGS. 7A and 7B are block diagrams showing the entire structure of a device for adjusting the characteristics of the dielectric filter. In FIG. 7A, a dielectric filter DUT is a dielectric filter which is either a sample or an object to be adjusted, which is set in a measuring tool. A network analyzer measures the filter characteristics of the dielectric filter DUT. A controlling unit comprises a calculating unit, a memorizing unit, an outputting unit, and an inputting unit. For example, the controlling unit may be comprised of a microcomputer having input/output ports. Based on control data given by the controlling unit, a trimming unit trims only specified amounts and specified parts of a conductive film and a dielectric member in the dielectric filter DUT. In this example, although adjustment of the characteristics is performed by trimming the conductive film and the dielectric member, for instance, it is also possible to adjust the characteristics by attaching a dielectric member or dielectric material to a specified part of the dielectric filter or by forming a conductive film on a specified part thereof. In the former case, the amount of trimming is equivalent to the amount of adjustment, and, in the latter case, the amount of dielectric material attached or the amount of conductive film formed is equivalent to the amount of adjustment.

In FIG. 7A, a file server stores a database showing the relationships between filter characteristics before adjustment and the amount of adjustment necessary for the dielectric filter. If the database is contained in the controlling unit, the file server is not necessary.

FIG. 7B shows a structural example comprising a plurality of adjusting devices. As shown here, when the plurality of adjusting devices is used, one database is shared for common use among them, with the result that any of the adjusting devices can make the same adjustment of the characteristics.

Figures 8, 9:
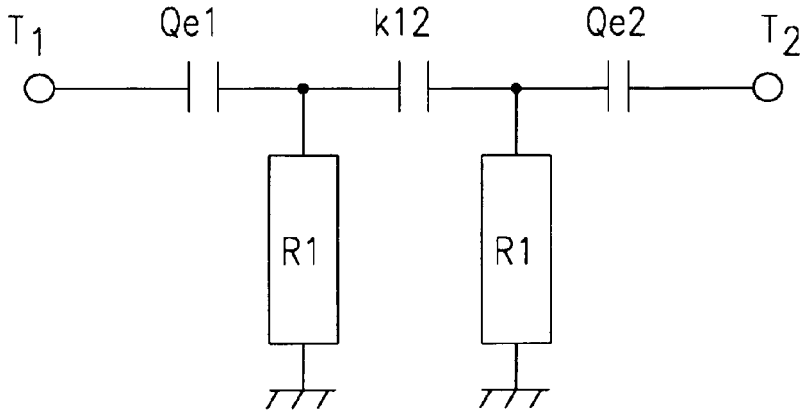
FIG. 8 is an equivalent circuit diagram of the dielectric filter.
FIG. 9 is a chart showing elements of the equivalent circuit of the dielectric filter and examples of the characteristic values of the elements.

FIG. 8 is an equivalent circuit diagram of the dielectric filter as a model illustrated in the second embodiment of the present invention. In this case, the dielectric filter is used as a band pass filter using discrete dielectric resonators R1 and R2. In FIG. 8, reference character Qe1 indicates an external coupling capacitance generated between an external terminal T1 and the resonator R1, and reference character Qe2 indicates an external coupling capacitance generated between an external terminal T2 and the resonator R2. Reference character k12 indicates a coupling capacitance between the two resonators R1 and R2.

FIG. 9 shows an example in which the characteristic values of those elements of the equivalent circuit shown in FIG. 8 are changed in three phases. In this case, reference character CQe1 indicates a capacitance value of the external coupling capacitance Qe1, reference character CQe2 indicates a capacitance value of the external coupling capacitance Qe2, and reference character Ck12 indicates a capacitance value of the element k12. In addition, reference character $\epsilon r$ indicates a relative permittivity of the dielectric parts of the two resonators R1 and R2, reference character Za indicates characteristic impedance obtained when the resonators are regarded as lines, and reference character L indicates a resonator length.

FIG. 10 shows the filter characteristics of the dielectric filter obtained when the characteristic values of the elements in the equivalent circuits of the dielectric filter as the above-described model are changed in three phases, and the amounts of adjustment appropriate to the elements of the equivalent circuit obtained under a condition in which the characteristics are provided so as to obtain targeted filter characteristics. In this figure, reference characters A1 and A2 indicate numbers given to the rows of items related to pass characteristics, reference characters B1 to B7 indicate numbers given to the rows of items related to reflection characteristics, and reference characters C1 to C5 indicate numbers given to the rows of items related to various kinds of adjustments.

Figure 11:
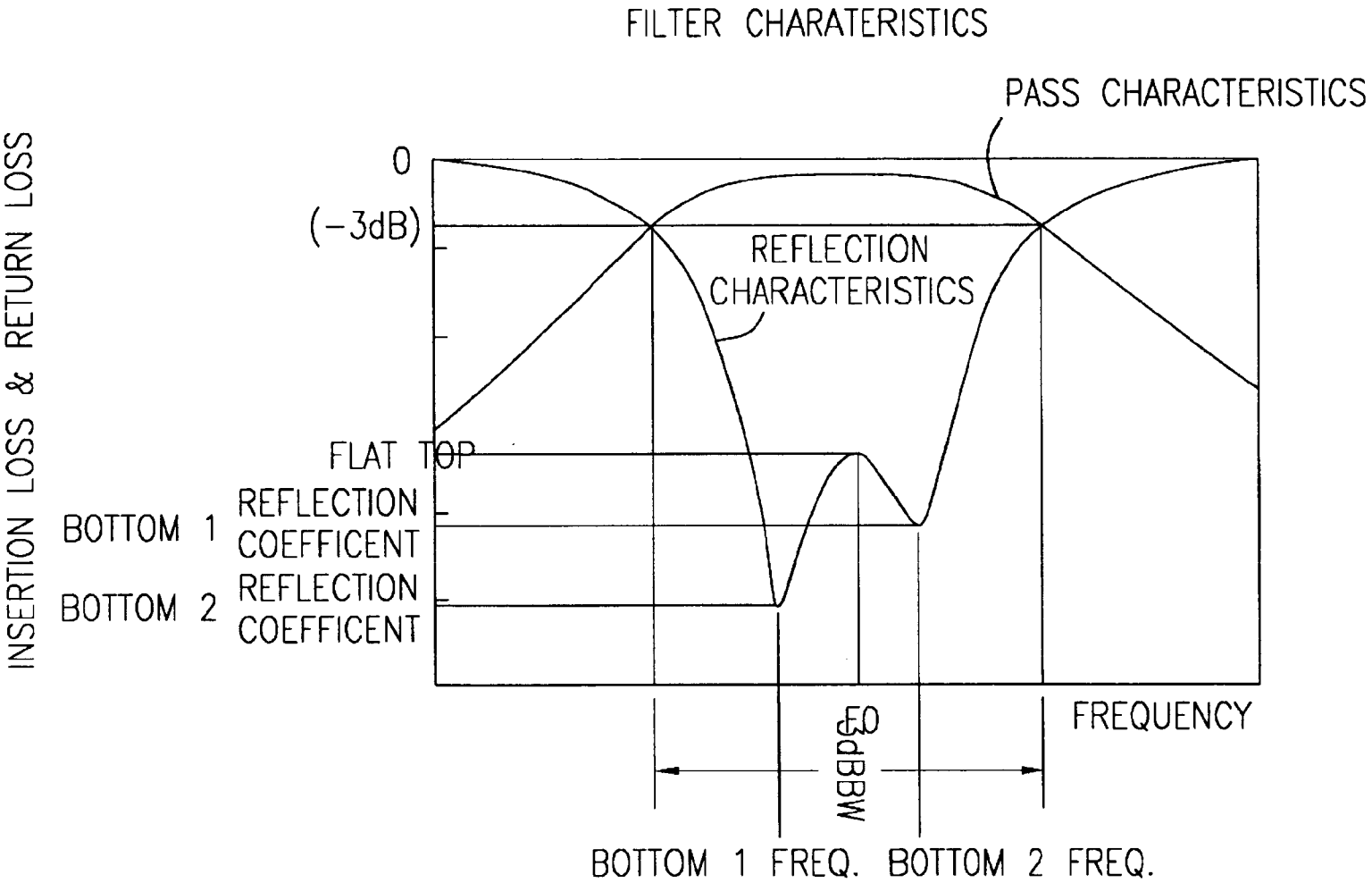
FIG. 11 is a chart showing the relationships between the filter characteristics and the characteristic values.

FIG. 11 shows the relationship between the example of the filter characteristics and the characteristic values shown in FIG. 10. In FIGS. 11 and 10, the symbol [FO] indicates the central frequency of a pass band. The symbol [3 dB BW] indicates the width of the pass band, which is the width of a frequency attenuated by 3 dB from a minimum-loss level. The reference character [Bottom number] indicates the number of attenuations occurring in valley-wave forms in the reflection characteristics, generated in the vicinity of both sides of the pass band, the reference character [Bottom 1 Freq.] indicates a frequency on the lower-frequency side in which the reflection characteristics are the smallest, and the reference character [Bottom 2 Freq.] indicates a frequency on the higher-frequency side in which the reflection characteristics are the smallest. The reference character [Bottom 1 Reflection Coefficient Factor] indicates a reflection coefficient at the frequency [Bottom 1 Freq.], and the reference character [Bottom 2 Reflection Coefficient Factor] indicates a reflection coefficient at the frequency [Bottom 2 Freq.] The reference character [Flat Top Freq.] indicates a frequency whose reflection loss is the largest between the [Bottom 1 Freq.] and the [Bottom 2 Freq.] The reference character [Flat Top Reflection Coefficient Factor] indicates the coefficient of the reflection loss.

In addition, in the row-direction, FIG. 10 shows the above-described filter characteristics of eleven kinds of dielectric filters, in which the characteristic values of elements of the equivalent circuit of the dielectric filter are changed in three phases. In this case, the symbolic character Center shows targeted filter characteristics, in which adjusted amounts are zero. The symbolic character R1-low shows filter characteristics obtained when the resonant frequency of the resonator R1 is low. As shown in the row C4, a filter characteristic indicated by Center is obtained when a value of the amount of adjusting the resonator length L of the resonator R1 is −0.4 (when the resonator length decreases by 0.4) so as to increase the resonant frequency of the resonator R1. In addition, the symbolic character R1-high shows filter characteristics obtained when the resonant frequericy of the resonator R1 is high. The filter characteristic indicated by Center is obtained when the value of the amount of adjusting the resonator length L of the resonator R1 is +0.4 (when the resonator length increases by 0.4) so as to decrease the resonant frequency of the resonator R1. The same thing can be done in cases indicated by the symbolic characters R2-low and R2-high, which are equivalent to the cases of a low resonant frequency and a high resonant frequency, respectively, of the resonator R2.

Furthermore, the symbolic character k12-low shows the case of a small coupling capacitance. As shown in the row C3, a filter characteristic indicated by Center can be obtained when a value of the amount of adjusting the coupling apacitance value Ck 12 is +0.5 so as to increase the coupling capacitance. The symbolic character k12-high shows a case opposite to that situation.

The symbolic character Qe1-low is equivalent to the case of a small coupling capacitance. As shown in the row C1, the amount of adjusting the external-coupling capacitance value CQe1 is set to be +0.6 so as to increase the coupling capacitance, by which a filter characteristic indicated by Center can be obtained. The symbolic character Qe1-high shows a case opposite to that situation. Similarly, the symbolic characters Qe2-low and Qe2-high show cases of the other external coupling capacitances, in which the case of Qe2-low has a small external coupling capacitance and that of Qe2-high has a large external coupling capacitance.

FIGS. 12A to 20 show examples of filter characteristics before adjustment of the characteristics shown in FIG. 10. In these figures, slender lines marked "A" indicate targeted characteristics of insertion losses and reflection losses, which are the characteristics of Center shown in FIG. 10. As seen in these figures, the filter characteristics change according to the deviations of elements of the equivalent circuit.

In the above examples, in order to facilitate the understanding of the relationships between the characteristic values of the elements of the equivalent circuit of the dielectric filter and the filter characteristics, a situation has been described in which the characteristic values of the elements of the equivalent circuit of the dielectric filter are known in advance. However, actually, measurement of the characteristics of the dielectric filter permits only the filter characteristic values of FO, 3 dB BW, and the like, to be clarified, and the characteristic values of the elements of the equivalent circuit cannot be immediately obtained. Nevertheless, as shown in FIG. 10, since the relationships between the characteristic values of the filter and the amount of adjustment of adjusted parts are provided in advance in the form of a database, although the characteristic values of the elements of the equivalent circuit remain unknown, the amount of adjustment of the adjusted parts can be obtained from the characteristic values of the filter characteristics obtained by measuring the actual dielectric filter to be adjusted.

In order to make comparisons between the filter characteristics obtained by measuring and the database easier, the data shown in FIG. 10 is normalized, for instance, as shown in FIG. 15. (Some parts of the data shown in FIG. 10 are omitted in FIG. 15.) For example, the values of "Center" and "R1-Low" in Table 10 are 1000.62 and 995.90. In FIG. 15, the value of "Center" is shifted from 1000.62 to O. Accordingly, the value of "R1-Low" is shifted from 995.90 to −4.72, i.e., 995.90–1000.62. As described above, the data shown in FIG. 10 are "normalized" to the data in FIG. 15 by setting the value of the "Center" at a simple number.

In FIG. 15, ΔFO indicates a deviation from the targeted value of a central frequency, and Δ3 dB BW indicates a deviation from the targeted value of a pass-band width. ΔBottom 1 Freq. indicates a deviation from the targeted value of Bottom 1 Freq. and Bottom 1 Reflection Coefficient Ratio is a ratio with respect to a targeted Bottom 1 Reflection Coefficient. Similarly, ΔBottom 2 Freq indicates a deviation from the targeted value of Bottom 2 Freq. and Bottom 2 Reflection Coefficient Ratio is a ratio with respect to a targeted Bottom 2 reflection coefficient. Additionally, ΔFlat Top Freq. indicates a deviation from the targeted value of Flat Top Freq. and Flat Top Reflection Coefficient Ratio is a ratio with respect to a targeted Flat Top reflection coefficient.

Figure 16:
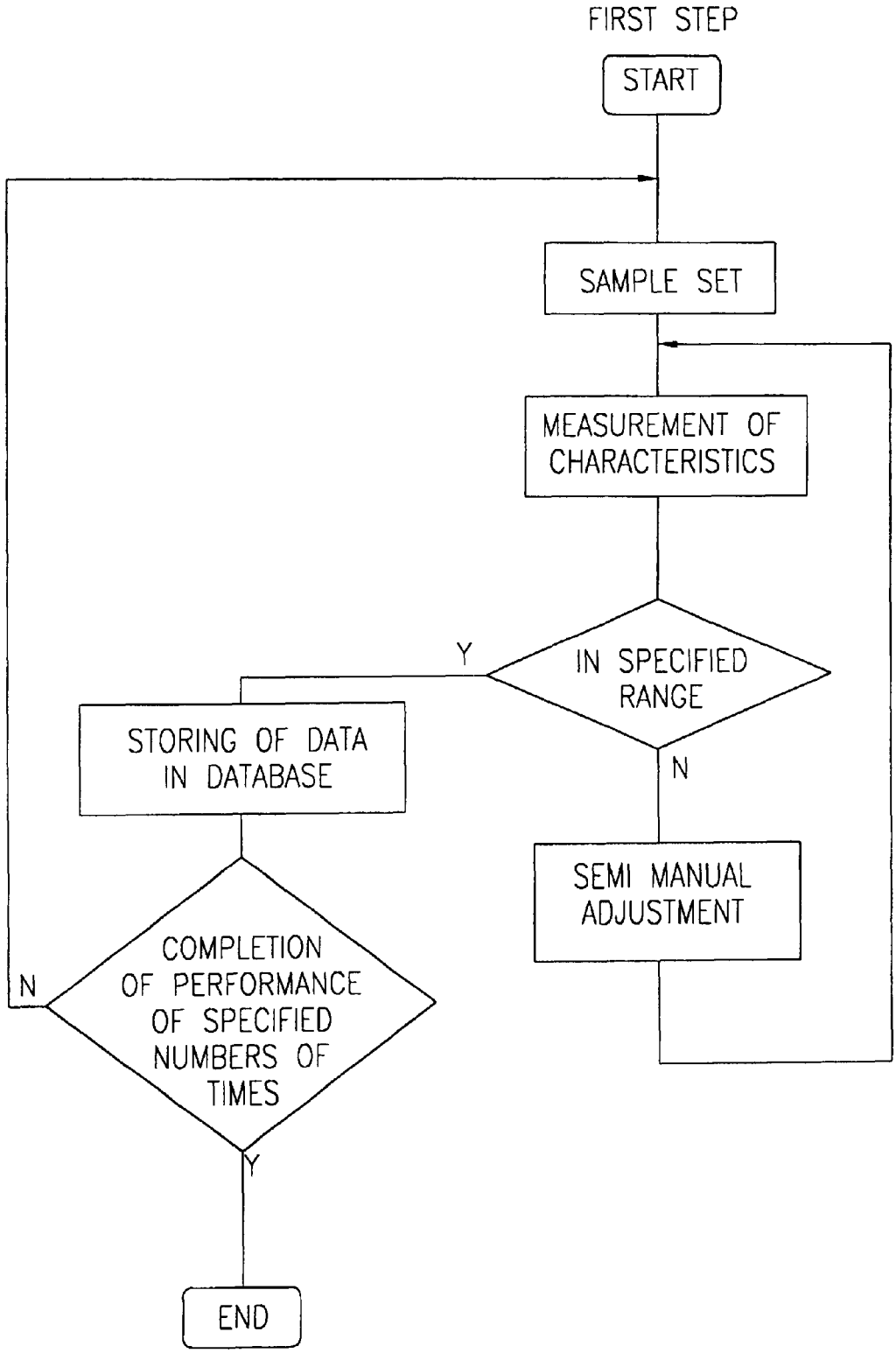
FIG. 16 is a flowchart illustrating the procedure of adjustments performed by a device for adjusting the characteristics of a dielectric filter.

FIG. 16 shows a flowchart illustrating the actual procedure for creating the database as shown in FIG. 15 by measuring and adjusting the characteristics of a dielectric filter. First, a sample dielectric filter before adjustment of the characteristics is set in a tool and its filter characteristics are measured with a network analyzer. When the filter characteristics are not in a specified range, an adjusting device is controlled so as to set the filter characteristics in the specified range, and adjustments of each of the parts to be adjusted are performed by semi-manual operations. Since the adjustment work includes adjustments at a phase in which no database is created, no reference data exists. However, since there is a correlation to some extent between the amount of adjustment of adjusted parts and changes in the filter characteristics according to the adjustments, the filter characteristics become closer to targeted ones, little by little, every time adjustments are performed.

Figure 12A:
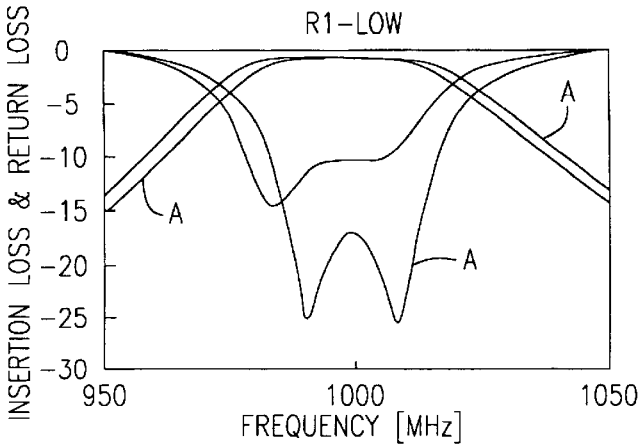
FIG. 12A, FIG. 12B, FIG. 12C and FIG. 12D show examples of changes in the filter characteristics and changes in the elements of the equivalent circuit.
Figure 12B:
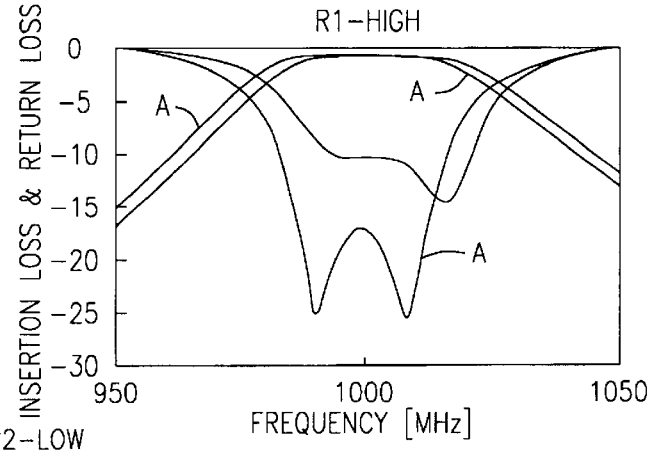
Figure 12C:
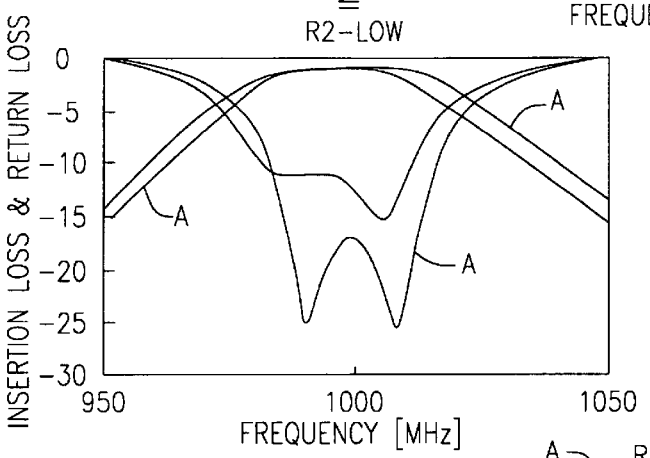
Figure 12D:
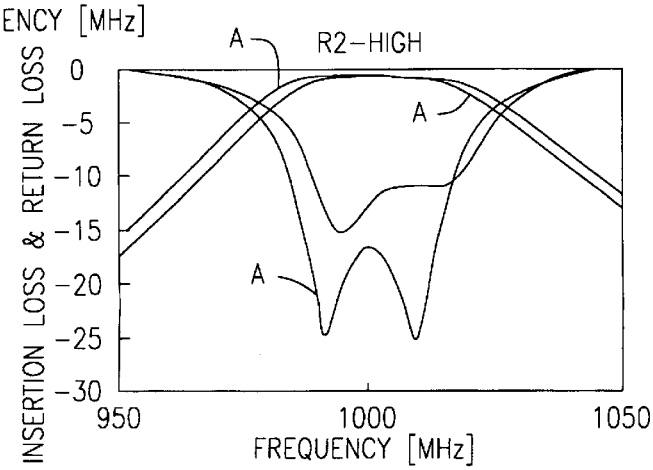
Figure 13A:
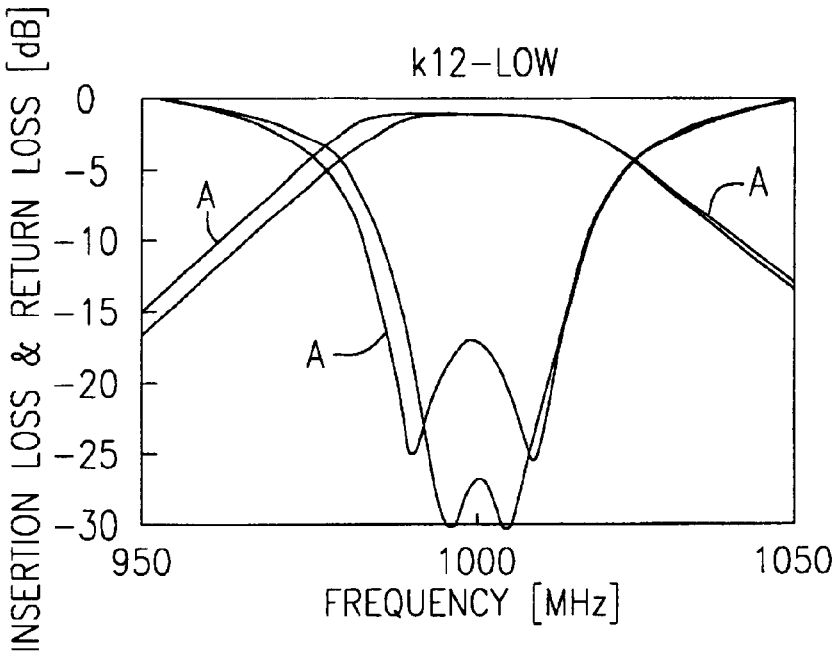
FIGS. 13A and 13B show examples of the changes in the filter characteristics corresponding to the changes in the elements of the equivalent circuit.
Figure 13B:
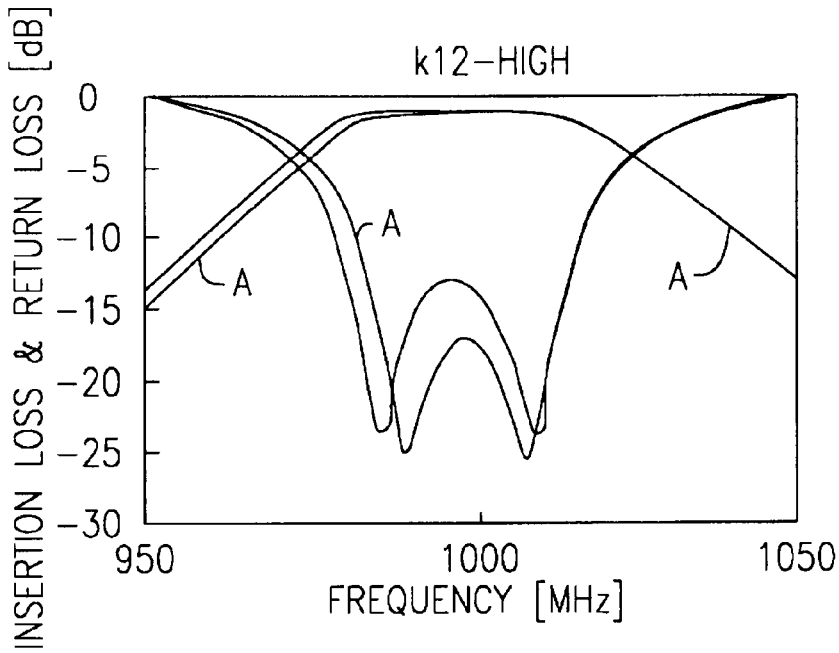
Figure 14A:
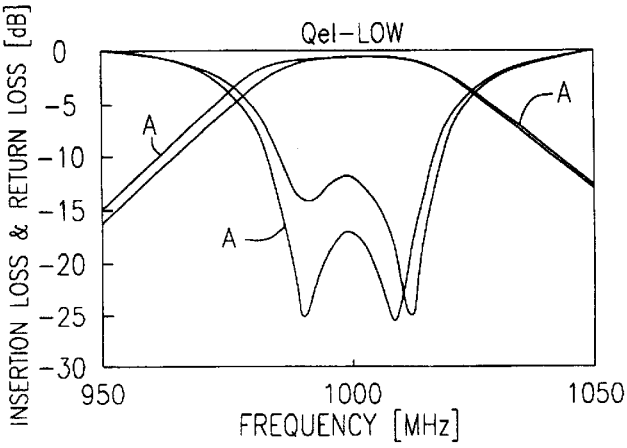
FIGS. 14A, 14B, 14C and 14D show respective examples of the changes in the filter characteristics corresponding to the changes in the elements of the equivalent circuit.
Figure 14B:
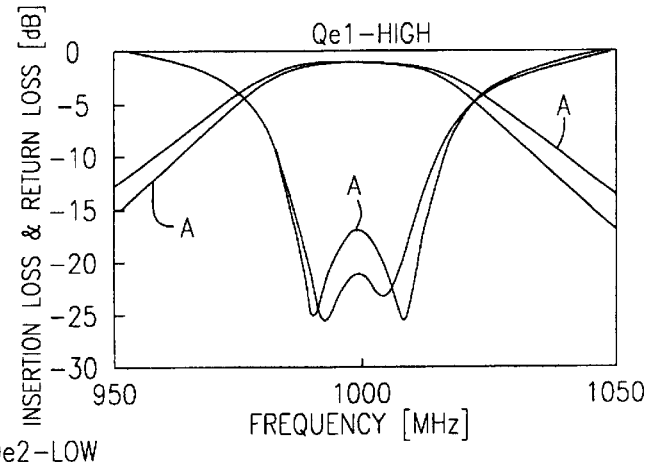
Figure 14C:
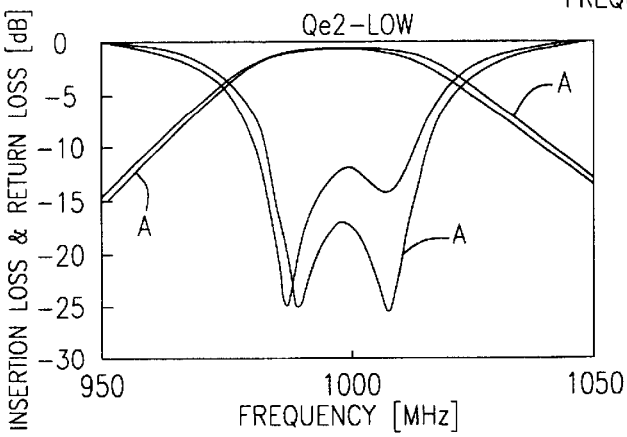
Figure 14D:
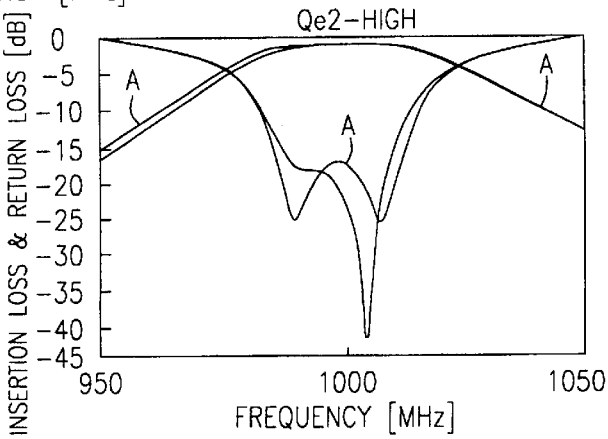

For example, as shown in FIGS. 12B and 12D, when the central frequency is higher than a targeted value, adjustments are performed such that the resonant frequency of the resonators R1 or R2 is decreased. As shown in FIGS. 12B and 12C, when the reflection characteristics of Bottom 1 are large (the reflection coefficient is large), adjustments are performed such that the resonant frequency of the resonator R2 is increased or the resonant frequency of the resonator R1 is decreased. In addition, as shown in FIG. 13B, when the pass-band width is larger than a targeted value, adjustments are performed such that the coupling capacitance between the two resonators is decreased.

When the adjustments that are performed by semi-manual operations permit the filter characteristics to be set in a specified range near the targeted value, the normalized data of the filter characteristics before adjustment of the characteristics and the amount of adjusting the adjusted parts are stored in the database. The above procedure is repeated on a plurality of the samples. Since there are variations in the filter characteristics of the dielectric filter before characteristic adjustments, the characteristics of the plurality of sample filters are adjusted, by which a database showing the relationships between the filter characteristics before adjustment of the characteristics and the appropriate amount of adjustment of the adjusted parts to obtain targeted filter characteristics is created.

Figure 17:
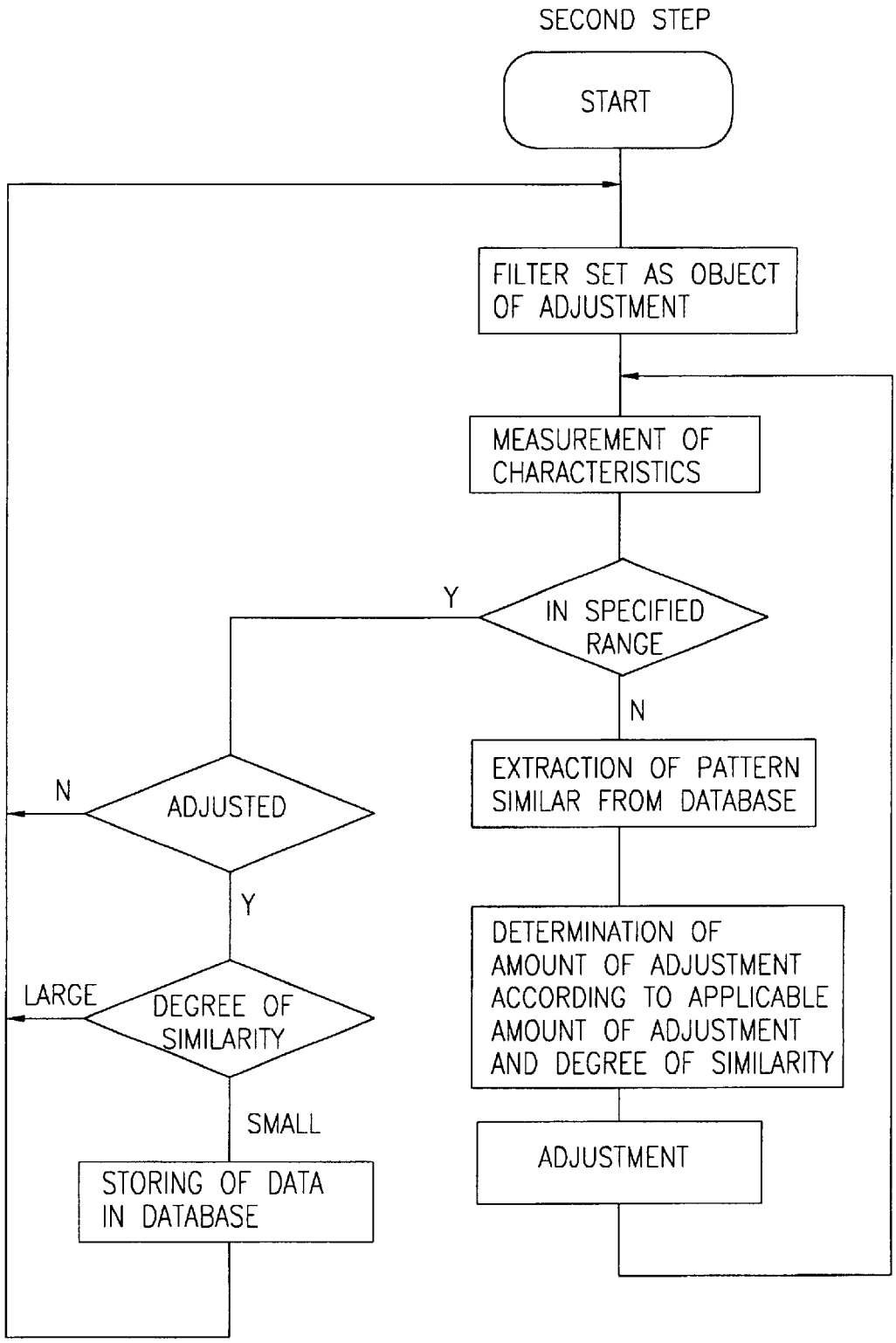
FIG. 17 is a flowchart illustrating the procedure of adjustments performed by a device for adjusting the characteristics of a dielectric filter.

FIG. 17 is a flowchart illustrating the actual procedure for adjusting the characteristics at a phase in which the above-described database contains a substantial amount of data. First, a dielectric filter to be adjusted is set in a tool to measure the filter characteristics thereof. Adjustments after that are not necessary and the procedure is completed, if the filter characteristics are in a specified range which has the targeted value at the center. However, when the filter characteristics are not in that range, a pattern similar to the filter characteristics before adjustment of the characteristics, which are measured in this case, is extracted from the above-described normalized database. In this situation, the filter characteristics before adjustment of the characteristics, as shown in FIG. 15, are equivalent to normalized values based on the targeted characteristic values of the dielectric filter.

In this way, the amount the adjusted parts are to be adjusted can be determined by extracting similar patterns. The higher is the degree of similarity between the extracted patterns and the real patterns, the higher is a weight based on the degree of similarity that is assigned to the amount of the adjustment. In other words, the higher the degree of similarity, the higher a weight coefficient which is assigned to the amount of adjustment, and the larger the amount of one-time adjustment. In contrast, the lower the degree of similarity, the smaller the amount of one-time adjustment. Then, actually, adjustments only according to the amount of adjustment are automatically performed and the filter characteristics are measured again. If the filter characteristics are not yet in the specified range, another pattern similar to the filter characteristics is, again, extracted from the database, and the amount of adjustment is obtained according to the pattern so as to make adjustments corresponding to the amount of adjustment.

As described here, the higher the degree of similarity, the higher the weight coefficient with respect to the amount of adjustment, with the result that adjustment efficiency is enhanced. In contrast, when the degree of similarity is low, the accuracy of the amount of adjustment based on the database is low. Therefore, excessive adjustments can be prevented, because the method suppresses the amount of one-time adjustment, when the degree of similarity is low.

The above-described procedure is repeated so as to set the filter characteristics in the specified range. Furthermore, when the filter characteristics are contained in the specified range by repeating adjustment of the characteristics, the first filter characteristics before adjustment of the characteristics and the cumulative amount of adjusting the adjusted parts are set as a pair of data to be normalized and stored in the database. The procedure is repeated to make adjustments of the characteristics of the dielectric filter so as to substantially increase the content of the database.

In the above example, every time the characteristics of one dielectric filter are adjusted, the amount of data in the database is increased. However, as shown in FIG. 17, only when the degree of similarity between the pattern of the filter characteristics before adjustment of the characteristics and the pattern of the database is small, new data is stored in the database, by which efficient adjustments of the characteristics can be performed even in a dielectric filter having various initial characteristics (the filter characteristics of the dielectric filter before adjustment of the characteristics), based on the database with a small amount of data. In addition, when the amount of the data stored in the database is increased to some extent, entering of data in the database may be prohibited.

In the above-described embodiment of the invention, in order to simplify illustration and understanding, a band pass filter of two stages is used as an example. However, the present invention can similarly be applied to a dielectric duplexer comprising two dielectric filters, for example a duplexer produced by forming a conductive film on a single dielectric member such as a dielectric block. In other words, in the case of the dielectric duplexer, the characteristics of a transmitting filter part and the characteristics of a receiving filter part can be individually adjusted. Furthermore, from the respective filter characteristics of the filters, it is also possible to optimize the branch characteristics of an antenna port. This arrangement permits a dielectric duplexer with satisfactory branch characteristics to be easily produced, in which a transmitted signal can be prevented from passing through the receiving filter and a received signal can be prevented from passing through the transmitting filter.

While the invention has been particularly shown and described with reference to embodiments thereof, it will be understood by those skilled in the art that the foregoing and other changes in form and details may be made therein without departing from the spirit of the invention.

What is claimed is:

1. A method for adjusting the characteristics of a dielectric filter of the type which includes first and second resonators formed, at least in part, by a conductive film located on a dielectric material, the first and second resonators cooperating with one another to form a band pass filter having a central band pass, the degree of coupling between the first and second resonators being indicated by a coupling coefficient, wherein the dielectric filter is a first dielectric filter, the method comprising:

determining the values of the central frequency and coupling characteristic;

determining the amount that the conductive film and dielectric material should be trimmed to change the central frequency and coupling characteristic to target values as a function of both the determined values and stored data representing the relationship between amounts of the conductive film and dielectric material which are trimmed and the resulting changes in the values in the central frequency and coupling coefficient; and trimming the conductive film and dielectric material as a function of the so determined amount;

testing a standard dielectric filter having the same nominal structure as the first dielectric filter to obtain data indicating the relationship between amounts of the conductive film and dielectric material of the standard dielectric filter which are trimmed and the resulting changes in the values in the central frequency and coupling coefficient of the standard dielectric filter; and storing the so obtained data as the stored data.

2. The method of claim 1, wherein the standard dielectric filter is tested by sequentially removing a plurality of trimming amounts of the conductive film and dielectric material and, after each such removal, determining the changes in the values in the central frequency and coupling coefficient of the standard dielectric filter.

3. A method for adjusting the characteristics of a dielectric filter of the type which-includes firsthand second resonators formed, at least in part, by a conductive film located on a dielectric material, the first and second resonators cooperating with one another to form a band pass filter having a central band pass, the degree of coupling between the first and second resonators being indicated by a coupling coefficient, wherein the dielectric filter is a first dielectric filter, the method comprising:

determining the values of the central frequency and coupling characteristic;

determining the amount that the conductive film and dielectric material should be trimmed to change the central frequency and coupling characteristic to target values as a function of both the determined values and stored data representing the relationship between amounts of the conductive film and dielectric material which are trimmed and the resulting changes in the values in the central frequency and coupling coefficient; and trimming the conductive film and dielectric material as a function of the so determined amount;

testing a standard dielectric filter having the same nominal structure as the first dielectric filter to obtain data indicating the relationship between amounts of the conductive film and dielectric material at first and second parts of the standard dielectric filter which are trimmed and the resulting changes in the values in the central frequency and coupling coefficient of the standard dielectric filter; and storing the so obtained data as the stored data, wherein the conductive film and dielectric material are trimmed at first and second parts, the trimming of the first part having a greater effect on the central frequency than on the coupling coefficient, the trimming of the second part having a greater effect on the coupling coefficient than on the central frequency, and wherein the stored data includes data representing the relationship between the amounts of the conductive film and the dielectric material which are trimmed at the first part and the resulting changes in the values of the central frequency and coupling coefficient and data representing the relationship between the amounts of the conductive film and the dielectric material which are trimmed at the second part and the resulting changes in the values of the central frequency and coupling coefficient.

4. The method of claim 3, wherein the standard dielectric filter is tested by removing a plurality of trimming amounts at first and second parts of the conductive film and dielectric material and determining the changes in the values in the central frequency and coupling coefficient of the standard dielectric filter as a function thereof.

5. The method of claim 4, further including:

re-determining the central frequency and coupling coefficient after the act of trimming; and adjusting the stored data if the central frequency and coupling coefficient are not within a predetermined range of the target values.

6. The method of claim 5, wherein the stored data is adjusted as a function of the difference between the actual central frequency and coupling coefficient after the act of trimming and the target values.

7. The method of claim 6, further including:

re-trimming the conductive film and dielectric material as a function of the so adjusted stored values.

8. The method of claim 7, wherein the act of re-trimming the conductive film comprises:

determining the amount of the conductive film and dielectric material which should be re-trimmed to change the central frequency and coupling characteristic to the target values as a function of both the actual central frequency and coupling characteristics after the act of trimming and the adjusted stored values.

9. The method of claim 8, wherein the adjusting and re-trimming acts are repeated until the actual central frequency and the coupling characteristic falls within a predetermined range of the target values.

10. A system for adjusting the characteristics of a dielectric filter of the type which includes first and second resonators formed, at least in part, by a conductive film located on a dielectric material, the first and second resonators cooperating with one another to form a band pass filter having a central band pass, the degree of coupling between the first and second resonators being indicated by a coupling coefficient, wherein the dielectric filter is a first dielectric filter, the system comprising:

(A) a computer for determining:

(1) the pre-trimming values of the central frequency and coupling characteristic; and (2) the amount that the conductive film and dielectric material should be trimmed to change the central frequency and coupling characteristic to target values as a function of both the pre-trimmed values and stored data representing the relationship between amounts of the conductive film and dielectric material which are trimmed and the resulting changes in the values in the central frequency and coupling coefficient;

(B) a cutting device for trimming the conductive film and dielectric material as a function of the so determined amount, wherein the cutting device trims the conductive film and the dielectric material at first and second parts, the trimming of the first part having a greater effect on the central frequency than on the coupling coefficient, the trimming of the second part having a greater effect on the coupling coefficient than on the central frequency; and (C) a testing apparatus for testing a standard dielectric filter having the same nominal structure as the first dielectric filter to obtain data indicating the relationship between amounts of the conductive film and dielectric material of the standard dielectric filter which are trimmed and the resulting changes in the values in the central frequency and coupling coefficient of the standard dielectric filter, wherein the data so obtained is the stored data, and the stored data includes data representing the relationship between the amounts of the conductive film and the dielectric material which are trimmed at the first part and the resulting changes in the values of the central frequency and coupling coefficient and data representing the relationship between the amounts of the conductive film and the dielectric material which are trimmed at the second part and the resulting changes in the values of the central frequency and coupling coefficient.

11. The system of claim 10, wherein the testing apparatus tests the standard dielectric filter by sequentially removing a plurality of trimming amounts of the conductive film and dielectric material and, after each such removal, determining the changes in the values in the central frequency and coupling coefficient of the standard dielectric filter.

12. A system for adjusting the characteristics of a dielectric filter of the type which includes first and second resonators formed, at least in part, by a conductive film located on a dielectric material, the first and second resonators cooperating with one another to form a band pass filter having a central band pass, the degree of coupling between the first and second resonators being indicated by a coupling coefficient, the system comprising:

(A) a computer for determining:

(1) the pre-trimming values of the central frequency and coupling characteristic; and (2) the amount that the conductive film and dielectric material should be trimmed to change the central frequency and coupling characteristic to target values as a function of both the pre-trimmed values and stored data representing the relationship between amounts of the conductive film and dielectric material which are trimmed and the resulting changes in the values in the central frequency and coupling coefficient; and (B) a cutting device for trimming the conductive film and dielectric material as a function of the so determined amount, wherein the dielectric filter is a first dielectric filter and the testing apparatus further tests a standard dielectric filter having the same nominal structure as the first dielectric filter to obtain data indicating the relationship between amounts of the conductive film and dielectric material at first and second parts of the standard dielectric filter which are trimmed and the resulting changes in the values in the central frequency and coupling coefficient of the standard dielectric filter; and wherein the so obtained data is the stored data.

13. The system of claim 12, wherein the testing apparatus tests the standard dielectric filter by removing a plurality of trimming amounts at first and second parts of the conductive film and dielectric material and determines the changes in the values in the central frequency and coupling coefficient of the standard dielectric filter as a function thereof.

14. The system of claim 13, wherein the testing equipment further determines the central frequency and coupling coefficient after the trimming has been completed and wherein the stored data is adjusted if the central frequency and coupling coefficient are not within a predetermined range of the target values.

15. The system of claim 14, wherein the stored data is adjusted as a function of the difference between the actual central frequency and coupling coefficient after the act of trimming and the target values thereof.

16. The system of claim 15, wherein the cutting device re-trims the conductive film and dielectric material as a function of the so adjusted stored values.

17. The system of claim 16, wherein the computer determines the amount of the conductive film and dielectric material which should be re-trimmed to change the central frequency and coupling characteristic to the target values as a function of both the actual central frequency and coupling characteristics after the act of trimming and the adjusted stored values.

18. The system of claim 17, wherein the computer and the cutting device repeat the adjusting and re-trimming acts until the actual-central frequency and the coupling characteristic falls within a predetermined range of the target values.

19. A method for adjusting the characteristics of a first dielectric filter, the method comprising:

determining the initial filter characteristics of the first dielectric filter;

determining the amount of the one or more parts of the first dielectric filter which must be trimmed to reach target values of the filter characteristics as a function of the initial filter characteristics and a database representing the relationship between amounts of the conductive film and dielectric material which are trimmed and the resulting changes in the values in the filter characteristics;

trimming the one or more parts by the so determined amount; and testing a standard dielectric filter having the same nominal structure as the first dielectric filter to obtain the database.

20. A system for adjusting the characteristics of a first dielectric filter, the system comprising:

a computer for determining:

the initial filter characteristics of the first dielectric filter; and the amount of the one or more parts of the first dielectric filter which must be trimmed to reach target values of the filter characteristics as a function of the initial filter characteristics and a database representing the relationship between amounts of the conductive film and dielectric material which are trimmed and the resulting changes in the filter characteristics;

a cutting device for trimming the one or more parts by the so determined amount; and a testing device for testing a standard dielectric filter having the same nominal structure as the first dielectric filter to obtain the database.

* * * * *